US006837931B1

(12) United States Patent
McGough

(10) Patent No.: US 6,837,931 B1
(45) Date of Patent: Jan. 4, 2005

(54) FLUID WASHER FOR A SPRAY BOOTH

(75) Inventor: Louis F. McGough, Rockford, MI (US)

(73) Assignee: Thierica, Inc., Grand Rapids, MI (US)

( * ) Notice: Subject to any disclaimer, the term of this patent is extended or adjusted under 35 U.S.C. 154(b) by 0 days.

(21) Appl. No.: 10/767,149

(22) Filed: Jan. 29, 2004

(51) Int. Cl.[7] ..... B05D 15/12

(52) U.S. Cl. ..... 118/326; 118/309; 118/DIG. 7; 55/DIG. 46

(58) Field of Search ..... 118/326, 309, 118/DIG. 7; 55/DIG. 46; 454/55; 96/228

(56) References Cited

U.S. PATENT DOCUMENTS

| | | | | |
|---|---|---|---|---|
| 2,337,983 A | | 12/1943 | Fisher | |
| 2,546,259 A | * | 3/1951 | Fenn | 96/271 |
| 3,112,352 A | | 11/1963 | Krantz | |
| 3,119,675 A | | 1/1964 | Gallagher | |
| 3,138,087 A | | 6/1964 | Larsson et al. | |
| 3,168,030 A | | 2/1965 | Wilhelmsson et al. | |
| 3,328,009 A | | 6/1967 | Panzica et al. | |
| 3,421,293 A | | 1/1969 | Halls | |
| 3,737,106 A | | 6/1973 | Arnold et al. | |
| 3,782,080 A | | 1/1974 | Gallagher | |
| 3,798,880 A | | 3/1974 | Arnold et al. | |
| 3,985,922 A | | 10/1976 | Thornton et al. | |
| 4,173,924 A | | 11/1979 | Bradshaw | |
| 4,239,512 A | | 12/1980 | Dobias | |
| 4,295,866 A | | 10/1981 | Kearny | |
| 4,328,012 A | | 5/1982 | Telchuk, Jr. et al. | |
| 4,399,742 A | | 8/1983 | Dobias | |
| 4,521,227 A | | 6/1985 | Gerdes et al. | |
| 4,643,082 A | | 2/1987 | Lynham et al. | |
| 4,904,393 A | | 2/1990 | Mitchell et al. | |
| 4,984,595 A | | 1/1991 | Josefsson | |
| 5,040,482 A | | 8/1991 | McGuire et al. | |
| 5,092,928 A | | 3/1992 | Spangler | |
| 5,135,550 A | | 8/1992 | Telchuk et al. | |
| 5,147,422 A | | 9/1992 | Neeley et al. | |
| 5,356,334 A | | 10/1994 | Gray | |
| 5,560,860 A | | 10/1996 | Walsh et al. | |
| 5,766,355 A | | 6/1998 | Josefsson et al. | |
| 5,985,154 A | | 11/1999 | Agree et al. | |
| 6,027,566 A | * | 2/2000 | Telchuk et al. | 118/326 |

* cited by examiner

*Primary Examiner*—Chris Fiorilla
*Assistant Examiner*—Yewebdar Tadesse
(74) *Attorney, Agent, or Firm*—Price, Heneveld, Cooper, DeWitt & Litton, LLP

(57) ABSTRACT

A water washer for spray booth includes a gas exhaust duct, an exhaust fan and a fluid pump. The duct includes an entrance and an exit, with the entrance of the duct including a plurality of apertures. The entrance of the duct is positioned to receive a gas mixed with a spray from a spray application area of a spray booth. The exhaust fan is positioned to draw the gas from the spray application area into the gas exhaust duct. The fluid pump is coupled to a source of fluid and fluid supply pipe, which is positioned to direct a fluid into the plurality of apertures at the entrance of the enclosure and thereby remove overspray from the gas drawn from the spray application area.

22 Claims, 3 Drawing Sheets

FLUID WASHER FOR A SPRAY BOOTH

BACKGROUND OF THE INVENTION

The present invention is generally directed to a spray booth and, more particularly, to a fluid washer for a spray booth.

A number of prior art spray booths have included features designed to remove overspray particles from air that was to be exhausted from the spray booths. For example, U.S. Pat. No. 5,092,928 discloses a conventional down-draft water washer paint booth that utilizes an overhead conveyor for transporting a workpiece through the booth. A paint application station disposed in a spray chamber of the booth includes one or more spray guns connected to a source of paint. The paint booth includes an open metal grate floor separating the booth into an upper chamber and a lower chamber. A water trough includes a supply of water that defines a water surface located in a lower chamber of the booth.

The booth of U.S. Pat. No. 5,092,928 also includes air exhaust ducts positioned at opposite sides of the spray chamber to provide an airflow path between the lower chamber of the booth and an external environment. Water headers, having associated spray nozzles, are mounted within the ducts. A pump provides a pressurized source of water to the spray nozzles, which direct a water spray into their respective exhaust ducts to form a spray zone within the ducts. A portion of the water spray provided by the spray nozzles is directed toward an interior wall of the duct to form a continuous water curtain across the openings into the duct. The booth also includes exhaust fans mounted to the exhaust ducts to provide for the movement of air from the spray chamber to the external environment. During operation, overspray laden air is directed from the upper chamber through the floor grate and into the lower chamber through water curtains and then through the water spray provided by the spray nozzles. The water washed air stream is then drawn upward through a plurality of baffles and discharged to the external environment.

U.S. Pat. No. 5,135,550 discloses a recirculating water washer that includes a water nozzle positioned to direct a spray of water into an opening in a baffle formed within an exhaust air duct. Paint laden air is pulled through the opening and the water spray removes the paint from the air, which is then exhausted out an exhaust port. A number of other prior art water washers have utilized spiral nozzles to provide a water spray into an opening provided in a baffle of an exhaust air duct. However, in general, water washers that have utilized spiral nozzles to provide a spray into an opening in a baffle of an exhaust air duct have experienced paint buildup on the nozzle, which affects the nozzle spray pattern and eventually tends to clog the nozzle, thus, requiring periodic cleaning to prevent uneven air flows and particulate being released to the atmosphere.

As such, it would be desirable to provide a fluid washer for a spray booth that effectively cleans the air, while at the same time requires less maintenance.

SUMMARY OF THE INVENTION

An embodiment of the present invention is directed to a fluid washer for a spray booth that includes a gas exhaust duct, an exhaust fan and a fluid pump. The gas exhaust duct includes an entrance and an exit, with the entrance of the duct including a plurality of apertures. The entrance of the duct is positioned to receive a gas mixed with a spray from a spray application area. The exhaust fan is positioned to draw the gas from the spray application area into the enclosure. The fluid pump is coupled to a source of fluid and a fluid supply pipe is positioned to direct the fluid into the plurality of apertures at the entrance of the duct. The fluid provided by the fluid supply pipe removes overspray from the gas drawn from the spray application area. In various embodiments of the present invention, the fluid may be water and the spray may be a solvent-based paint and/or a water-based paint. Typically, the gas is air.

In another embodiment of the present invention, the entrance to the duct is configured as a basket and a plurality of apertures are formed in a floor of the basket. According to a different aspect of the invention, the floor of the basket includes a centrally located deflection plate and the fluid pipe is positioned to direct the fluid onto the deflection plate. Various other embodiments of the enclosure include a plurality of baffles. According to another aspect of the invention, the gas exhaust duct is included as part of a spray booth.

These and other features, advantages and objects of the present invention will be further understood and appreciated by those skilled in the art by reference to the following specification, claims and appended drawings.

DETAILED DESCRIPTION OF PREFERRED EMBODIMENTS

The present invention is generally directed to a spray booth that requires less maintenance and is generally more economical to manufacture and operate. More specifically, various embodiments of the present invention are directed to a fluid washer for a spray booth that is both economical, exhibits reduced maintenance costs and can be operated for a longer period of time than existing spray booths under comparable conditions thus being more efficient at keeping paint particulate out of the exhaust stream. As stated above, prior water washers for spray booths have included spiral nozzles, located within an exhaust air duct of the water washer, positioned to direct a water spray into an entrance of the exhaust air duct. While spiral nozzles generally require less maintenance than other nozzles, spiral nozzles are still prone to clogging and, thus, require periodic maintenance. Further, as a spiral nozzle located within a gas exhaust duct accumulates overspray, such as paint, the spiral nozzle ceases to function in an efficient manner, such that air exhausted from the gas exhaust duct may no longer be cleaned, as required by various government regulations. As a result, existing spray booths require cleaning of the spiral nozzles and, as a result, have required periodic shutdown of a spray line.

According to one embodiment of the present invention, a nozzle is replaced by a fluid supply pipe that feeds a basket, with a perforated floor, that is located at an entrance of a gas exhaust duct. In at least one embodiment, the perforated floor includes a centrally located deflection plate to deflect a fluid, for example, water, provided by the fluid supply pipe. The deflection plate tends to increase the efficiency of the fluid spread and, thus, the cleaning of the exhausted air. It should be appreciated that the number of apertures and their size and location relative to each other are dependent upon the application. Further, the size of the fluid supply pipe, the distance between an end of the fluid supply pipe and the deflection plate and the pressure of the fluid supplied by the fluid supply pipe is application dependent.

For example, in one application, a perforated floor area of about 105 square inches includes apertures centered at about ⅜ inches and having a size of about ¼ inch. In this application, the deflection plate is centrally located and is about 2½ square inches and a fluid supply pipe of 1½ inches, operated at a pressure of about 28 psi, has its end located about 1.5 inches from the deflection plate.

Figure 1:
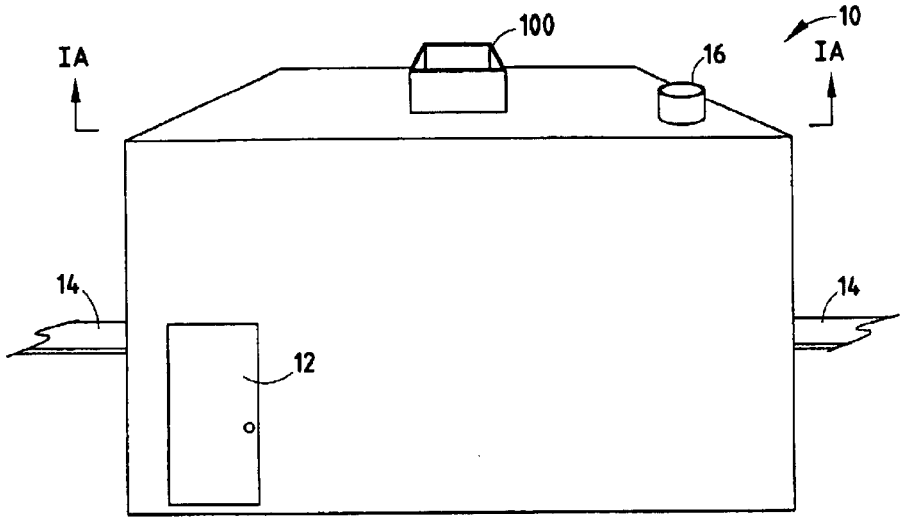
FIG. 1 is a perspective view of a spray booth.
Figure 1A:
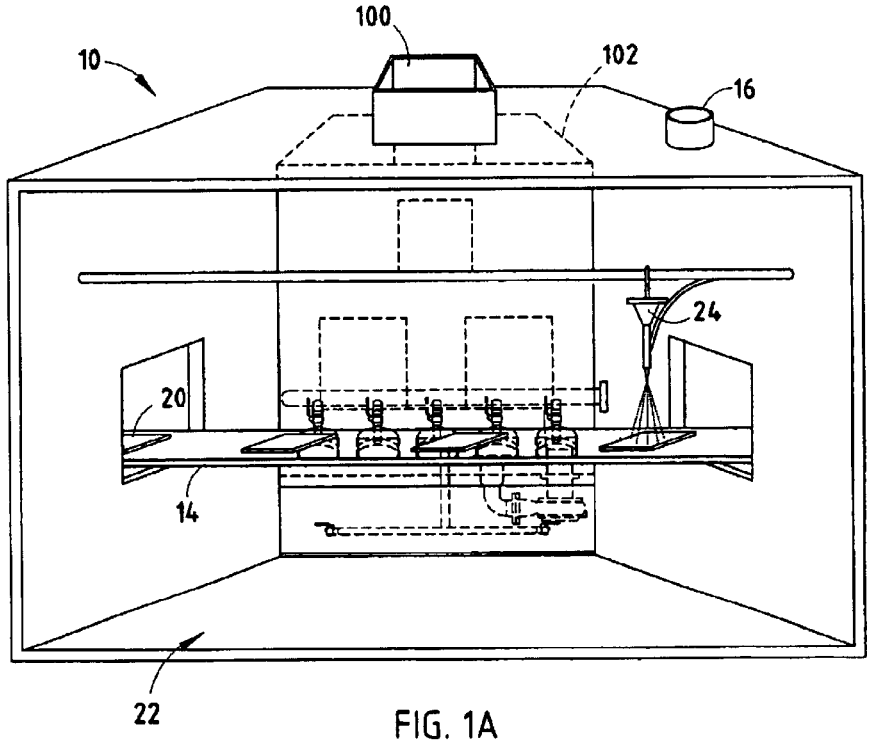
FIG. 1A is a cross-sectional view of the spray booth of FIG. 1.

With reference to FIG. 1, a perspective view of a spray booth 10 is depicted. As is shown, the spray booth 10 includes a door 12 that provides access to an interior of the booth 10 and a conveyor 14 transfers workpieces through the booth 10 such that the workpieces can be acted upon, e.g., sprayed with a solvent-based or water-based paint. The booth 10 includes a gas exhaust duct 100, which is part of a fluid washer 102, and a gas inlet 16. As is better shown in FIG. 1A, the conveyor 14 conveys a plurality of workpieces 20 through a spray application area 22 of the booth 10 such that a fluid applicator 24 can apply a fluid, e.g., a paint, to the workpieces 20. The gas inlet 16 provides gas, e.g., air, into the spray application area 22 of the booth 10 and, as is further described below, the gas is drawn through the spray application area 22 and into the gas exhaust duct 100 for cleaning.

Figure 2:
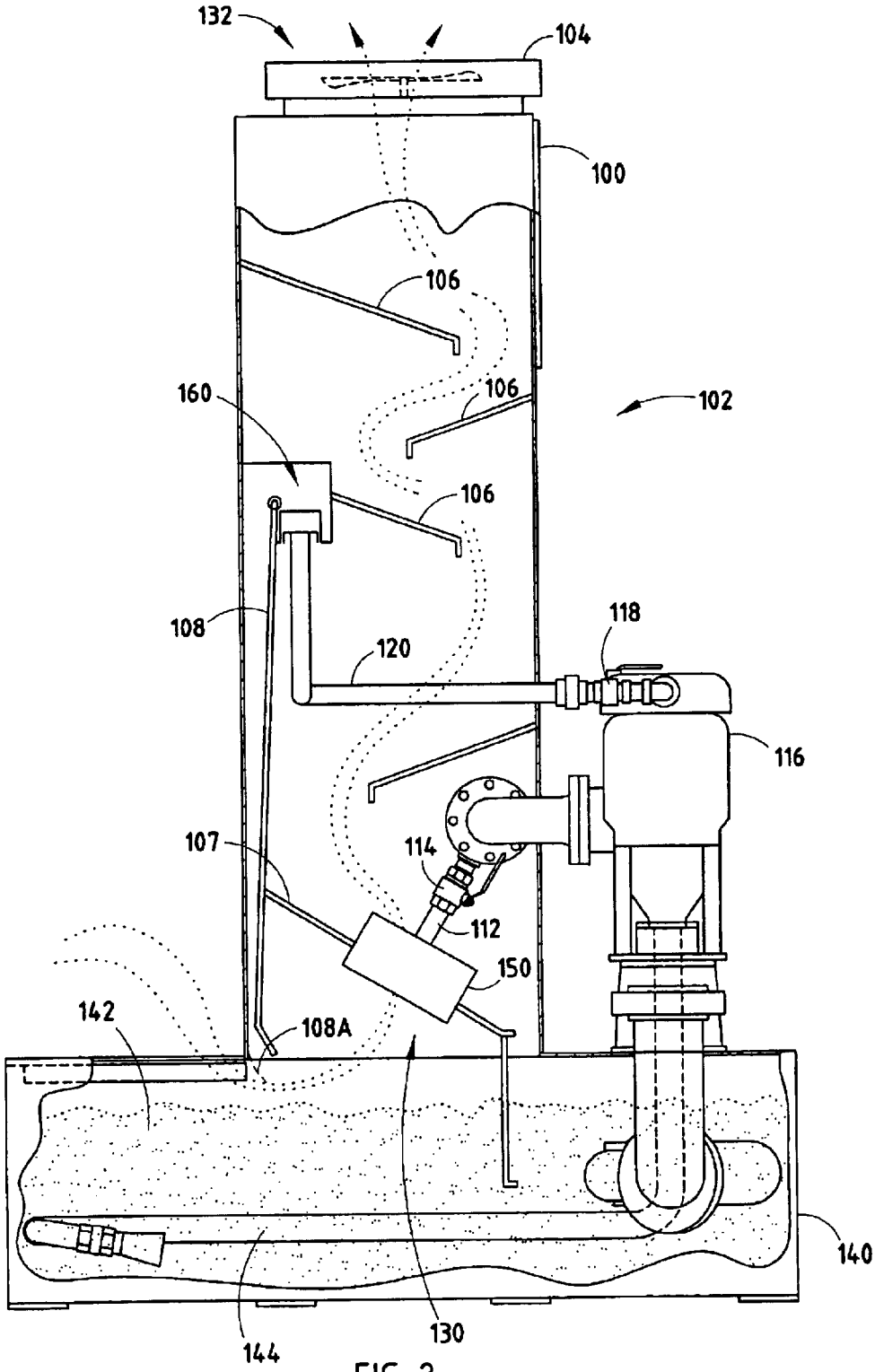
FIG. 2 is a partial cross-sectional view of a gas exhaust duct, constructed according to an embodiment of the present invention.

With reference to FIG. 2, a partial cross-section of the fluid washer 102, constructed according to one aspect of the present invention, is shown. The gas exhaust duct 100 is coupled at a lower end to a lower tank 140 that retains a supply of fluid 142 for washing overspray from the gas brought into an entrance 130 of the gas exhaust duct 100. As is shown, the gas exhaust duct 100 includes a plurality of internal baffles 106 that are utilized to control airflow and a baffle 108 that is utilized to provide a water curtain 108A approximate the entrance 130 of the gas exhaust duct 100. A motor/pump 116, some components of which are submerged within the fluid 142 in the lower tank 140, provides fluid (e.g., water), through a valve 114, to fluid supply pipe 112. An exhaust fan 104, mounted to the gas exhaust duct 100, pulls air through the entrance 130 of the gas exhaust duct 100 and out an exit 132 of the gas exhaust duct 100. The motor/pump 116 also provides fluid, through a valve 118 and a pipe 120, to an upper tank 160, which provides the fluid onto the baffle 108 to form the water curtain 108A. In operation, particle overspray laden gas (e.g., paint laden air) enters the air exhaust duct 100 after traveling through the water curtain 108A and through the perforated floor of basket 150, which is located in a lower baffle 107 of the air exhaust duct 100.

Figure 3:
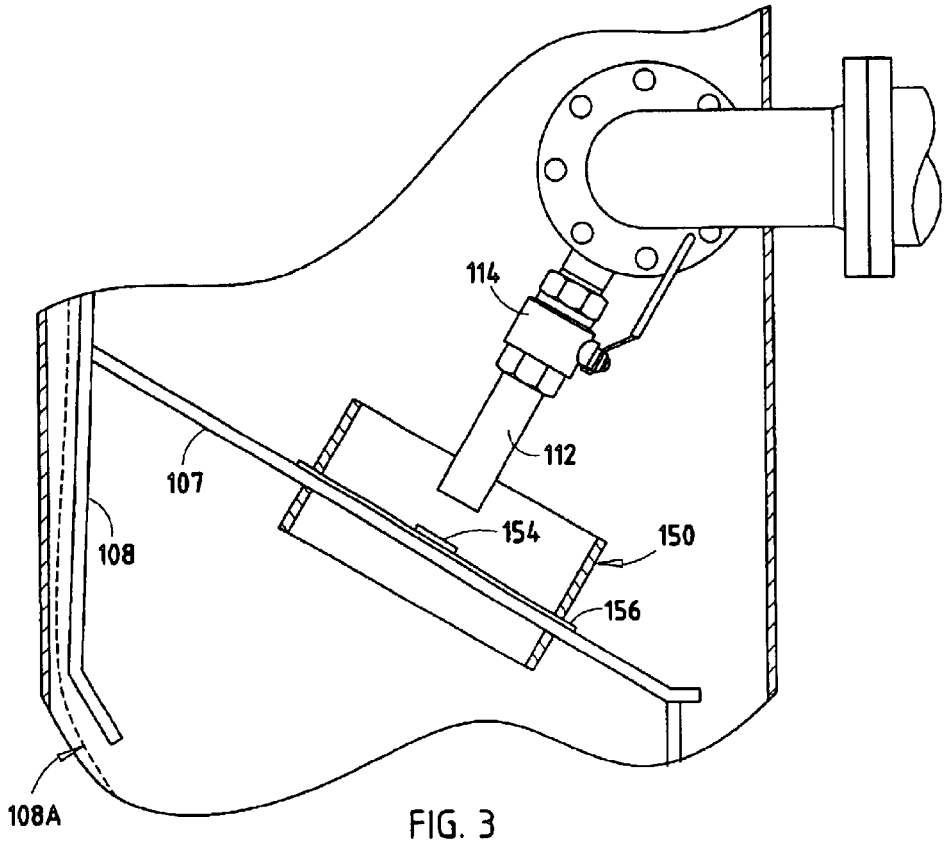
FIG. 3 is a detailed view of a fluid supply pipe feeding a basket formed in a lower baffle of a gas exhaust duct, constructed according to the present invention.
Figure 4:
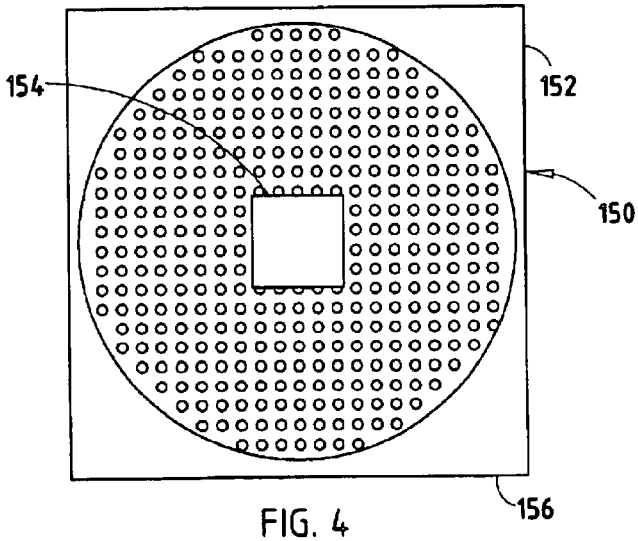
FIG. 4 is a top view of the basket of FIG. 3, constructed according to one aspect of the present invention.

With reference to FIGS. 3 and 4, the basket 150 includes a perforated floor 156 having a centrally located deflection plate 154. Alternatively, the perforated floor 156 may have an absence of apertures at its center and, thus, a separate deflection plate is not required. As discussed above, the location and size of the apertures in the perforated floor 156 are dependent upon the application and are sized to permit a proper air flow for a given application.

Accordingly, a fluid washer for a spray booth has been described herein that removes overspray from a gas drawn from a spray application area of a spray booth. In general, the fluid washer exhibits superior cleaning capability for a longer period of time than traditional water washers that have utilized a nozzle as the disclosed fluid washer, i.e., the combined fluid supply pipe and perforated exhaust gas duct entrance, is less prone to clogging and, thus, requires less maintenance at a reduced cost.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A spray booth, comprising:

an enclosure defining a spray application area and including a gas inlet positioned to provide a gas into the spray application area;

a gas exhaust duct including an entrance and an exit, wherein the entrance to the gas exhaust duct includes a plurality of apertures, and wherein the entrance of the gas exhaust duct is positioned to receive the gas mixed with a spray from the spray application area;

an exhaust fan positioned to draw the gas from the gas inlet through the spray application area and into the gas exhaust duct; and a fluid pump coupled to a source of fluid and a fluid supply pipe, wherein the fluid supply pipe is positioned to direct a fluid into the plurality of apertures at the entrance of the gas exhaust duct and thereby remove overspray from the gas drawn from the spray application area.

2. The booth of claim 1, wherein the fluid is water.

3. The booth of claim 1, wherein the spray is a solvent-based paint.

4. The booth of claim 1, wherein the spray is a water-based paint.

5. The booth of claim 1, wherein the gas is air.

6. The booth of claim 1, wherein the entrance to the gas exhaust duct is configured as a basket and the plurality of apertures are formed in a floor of the basket.

7. The booth of claim 6, wherein the floor of the basket includes a centrally located deflection plate covering a portion of the plurality of apertures, and wherein the fluid supply pipe is positioned to direct the fluid onto the deflection plate.

8. A paint booth, comprising:

an enclosure defining a paint application area and including an air inlet positioned to provide air into the paint application area;

an air exhaust duct including an entrance and an exit, wherein the entrance to the air exhaust duct includes a plurality of apertures, and wherein the entrance of the air exhaust duct is positioned to receive the air mixed with paint from the paint application area;

an exhaust fan positioned to draw the air from the air inlet through the paint application area and into the air exhaust duct; and a fluid pump coupled to a source of fluid and a fluid supply pipe, wherein the fluid supply pipe is positioned to direct a fluid into the plurality of apertures at the entrance of the air exhaust duct and thereby remove paint overspray from the air drawn from the paint application area.

9. The booth of claim 8, wherein the fluid is water.

10. The booth of claim 8, wherein the paint is a solvent-based paint.

11. The booth of claim 8, wherein the paint is a water-based paint.

12. The booth of claim 8, wherein the entrance to the air exhaust duct is configured as a basket and the plurality of apertures are formed in a floor of the basket.

13. The booth of claim 12, wherein the floor of the basket includes a centrally located deflection plate covering a portion of the plurality of apertures, and wherein the fluid supply pipe is positioned to direct the fluid onto the deflection plate.

14. The booth of claim 8, wherein the entrance to the air exhaust duct is configured as a basket and the plurality of apertures are formed in a floor of the basket, and wherein the floor of the basket includes a centrally located deflection plate and the fluid supply pipe is positioned to direct the fluid onto the deflection plate.

15. A fluid washer for a spray booth, the washer comprising:

a gas exhaust duct including an entrance and an exit, wherein the entrance of the gas exhaust duct includes a plurality of apertures and is positioned to receive a gas mixed with a spray from a spray application area;

an exhaust fan positioned to draw the gas from the spray application area into the gas exhaust duct; and a fluid pump coupled to a source of fluid and a fluid supply pipe, wherein the fluid supply pipe is positioned to direct a fluid into the plurality of apertures at the entrance of the gas exhaust duct and thereby remove overspray from the gas drawn from the spray application area.

16. The washer of claim 15, wherein the fluid is water.

17. The washer of claim 15, wherein the spray is a solvent-based paint.

18. The washer of claim 15, wherein the spray is a water-based paint.

19. The washer of claim 15, wherein the gas is air.

20. The washer of claim 15, wherein the entrance to the enclosure is configured as a basket and the plurality of apertures are formed in a floor of the basket.

21. The washer of claim 20, wherein the floor of the basket includes a centrally located deflection plate, and wherein the fluid supply pipe is positioned to direct the fluid onto the deflection plate.

22. The washer of claim 15, wherein the enclosure includes a plurality of baffles.

* * * * *